US007240705B2

(12) United States Patent
Alger

(10) Patent No.: US 7,240,705 B2
(45) Date of Patent: Jul. 10, 2007

(54) TABLE FOR PORTABLE MITER SAWS

(76) Inventor: Toby Alger, 171 Elliot Rd., Centerville, MA (US) 02632

( * ) Notice: Subject to any disclaimer, the term of this patent is extended or adjusted under 35 U.S.C. 154(b) by 185 days.

(21) Appl. No.: 11/039,875

(22) Filed: Jan. 24, 2005

(65) Prior Publication Data

US 2006/0162627 A1 Jul. 27, 2006

(51) Int. Cl.
*B25H 1/06* (2006.01)
*E04G 1/00* (2006.01)

(52) U.S. Cl. ..... 144/286.5; 182/181.1; 182/186.1; 182/186.2; 182/186.3; 83/469

(58) Field of Classification Search ..... 144/286.1, 144/286.5, 287; 182/181.1, 183.1, 186.1–186.7; 108/90, 124, 128; 83/469, 471
See application file for complete search history.

(56) References Cited

U.S. PATENT DOCUMENTS 467,081 A * 1/1892 Church ..... 182/151
2,618,525 A * 11/1952 Panzer ..... 108/172
2,689,154 A * 9/1954 Redler ..... 182/186.2
3,246,614 A * 4/1966 Loesch ..... 108/63
3,951,233 A * 4/1976 Meyers ..... 182/155
3,995,716 A * 12/1976 Bond ..... 182/186.1
4,640,386 A * 2/1987 Hall ..... 182/155
4,790,411 A * 12/1988 Ottoson ..... 182/129
4,974,651 A * 12/1990 Carmon et al. ..... 144/286.1
5,439,073 A * 8/1995 Johnson ..... 182/153
5,535,847 A 7/1996 DuRapau
6,092,627 A * 7/2000 Burger ..... 182/186.5
6,286,824 B1 9/2001 Sagol
6,659,440 B2 12/2003 Levy
6,672,348 B2 1/2004 Ransom et al.
D489,738 S 5/2004 Radermacher
2004/0250901 A1 12/2004 Ursell et al.
2005/0072493 A1* 4/2005 Velasco ..... 144/286.1
2005/0194215 A1* 9/2005 Radermacher ..... 182/181.1

* cited by examiner

*Primary Examiner*—Shelley M. Self
(74) *Attorney, Agent, or Firm*—Richard C. Litman

(57) ABSTRACT

A table for portable miter saws or the like comprising a hinged flat rectangular surface portions from which depends a centrally located, longitudinal keel. A sawhorse-like collapsible stand of two opposed leg assemblies forms a keel gap or slot upon erection within which the longitudinal keel snugly fits, thereby supporting the table surface. The leg assemblies have upper and middle cross members between end legs and the leg assemblies are attached at the end legs at each end thereof by upward folding hinge brackets. The upper cross members are trapezoidal in cross section, forming the vertical inner walls of the keel gap or slot when erected. The leg assemblies fold together and the table folds at its hinges for transport and storage. Levelers are provided for supporting a workpiece above the table top surface.

18 Claims, 9 Drawing Sheets

TABLE FOR PORTABLE MITER SAWS

BACKGROUND OF THE INVENTION

1. Field of the Invention

The present invention relates to worktables. More particularly, the present invention relates to folding, portable worktables for supporting miter saws.

2. Description of Related Art

Carpenters and others in the building trades need portable surfaces such as tables upon which they can set and stabilized materials being worked and the tools and equipment being utilized in the cutting and shaping of materials. For convenience, comfort, and efficiency, the level of the working surface is preferably about waist high to the user, and the work surface is stable. The supported surface or table should be collapsible and light in weight for ease of transportation and storage, and yet be durable and strong. Folding tables for supporting equipment and work materials are known and in wide use. Existing folding worktables suffer from instability, high cost, complexity, or ease of use, portability, and storage. It would be desirable to provide a folding, portable miter saw table useful for supporting a portable miter saw and work material which overcomes the above-mentioned shortcomings. Thus, a table for portable miter saws is desired.

SUMMARY OF THE INVENTION

The present invention is a collapsible, portable, carpenter's worktable made of a light material such as aluminum which is particularly useful as a support table for a portable miter saw. It features a flat, rectangular table surface having two equal, rectangular portions joined by hinges which fold together for storage. Each table portion has an elongate keel portion centrally affixed to its underside such that when the table surface is unfolded and laid flat, the two keel portions form a single, central keel extending the length of the table. The table is supported by a collapsible stand having a configuration similar to that of a common sawhorse. The collapsible stand, when in its erected position forms an elongate keel gap or slot receiving the central keel of the table surface, thus securely supporting and holding the table surface in place.

The collapsible stand includes two identical side assemblies connected by folding brace members so as to form the keel receiving elongate slot. Each side assembly includes a top cross member and a middle cross member extending between end legs having feet with non-skid pads. The cross members are secured to the legs by fasteners such as rivets and the middle cross member is further secured by a support bracket. The top cross members are trapezoidal in cross section with three flat, mutually perpendicular walls and a fourth wall facing outward and formed at an angle of about 15 degrees from the vertical so as to slope inward and upward. When the two side assemblies are brought together to form the stand, the flat vertical walls of the top cross members mutually face one another forming the sides of the elongate groove or keel gap. Space is maintained between the two upper cross members by a top folding bracket and a bottom folding bracket attached between the corresponding end legs at each end of the stand. When the stand is collapsed for storage, the folding brackets fold, allowing the two side assemblies to fold into a collapsed unit with the side assemblies parallel. When the stand is set up, the brackets unfold, allowing the side assemblies to form a sawhorse like table support with the legs sloping upward and inward.

The worktable can have a pair of leveler devices for use in further stabilizing materials being worked and in adjusting their elevation above the flat surface. The leveler devices may be conveniently used in conjunction with a miter saw.

It is an aspect of the invention to provide improved elements and arrangements thereof in an apparatus for the purposes described which is inexpensive, dependable, and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
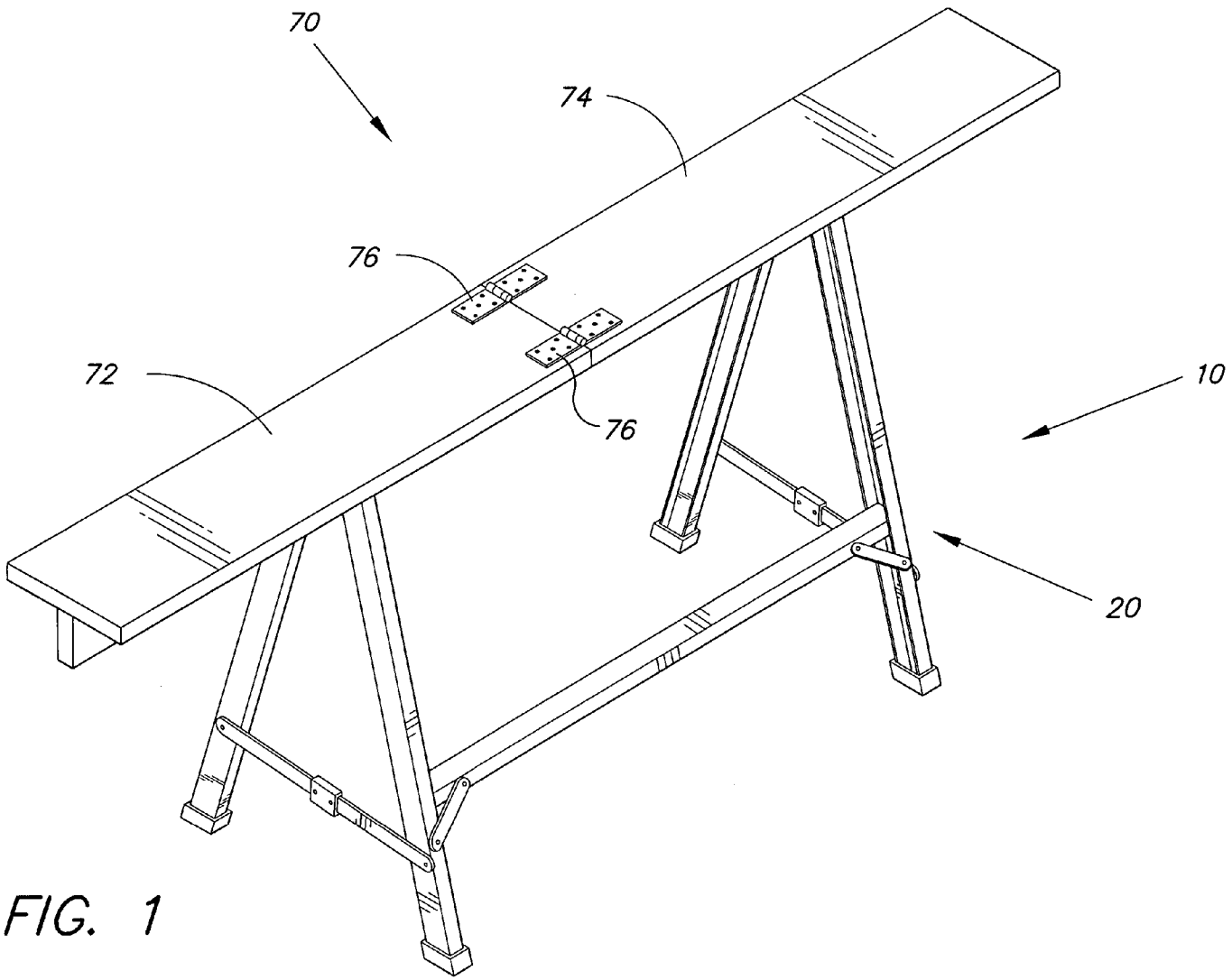
FIG. 1 is a perspective view of the portable miter saw table according to the present invention.
Figure 2:
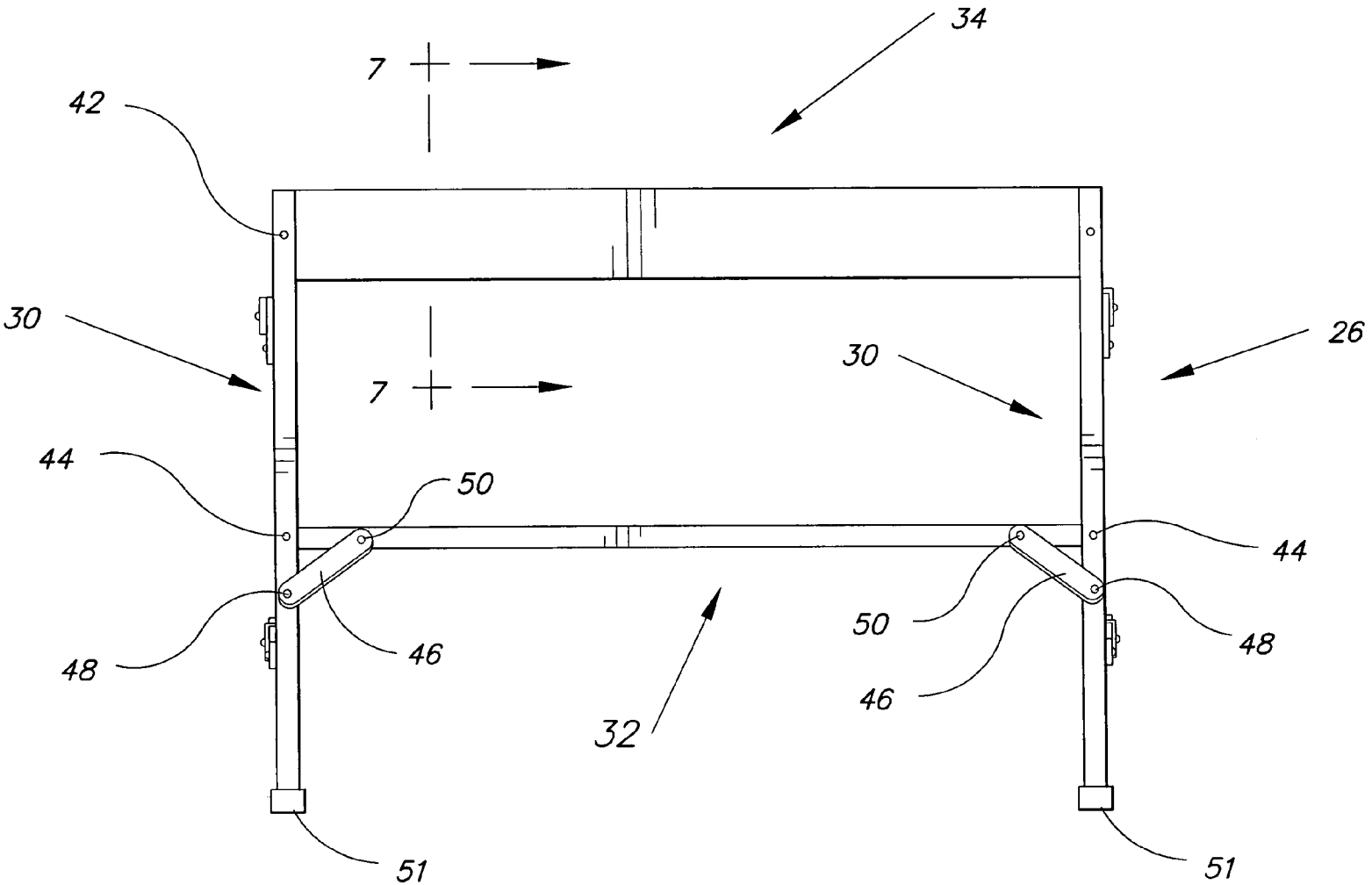
FIG. 2 is a side elevational view of the collapsible stand of FIG. 1.
Figure 3:
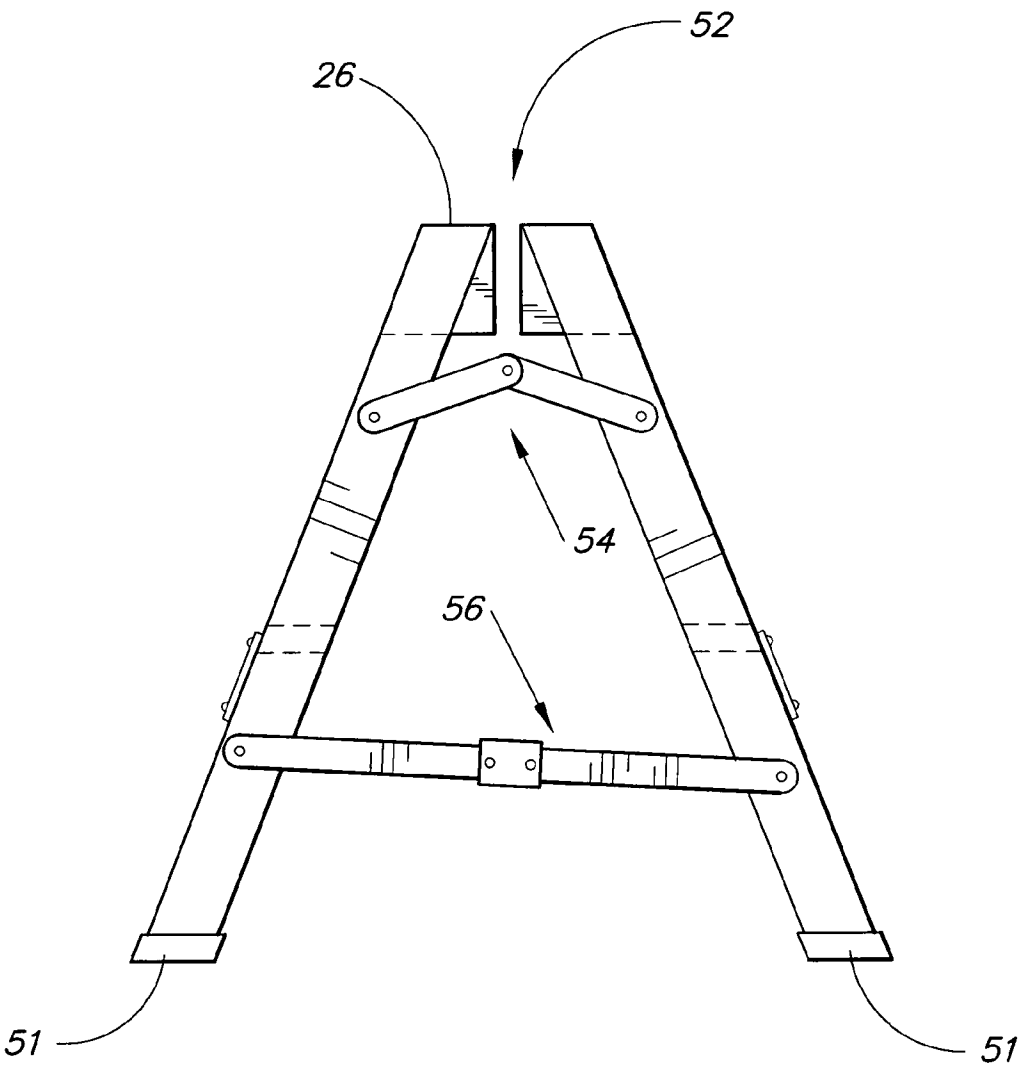
FIG. 3 is an end elevational view of the collapsible stand of FIG. 1.

The present invention is a collapsible portable miter saw worktable which includes a collapsible stand and a hinged flat table surface having a keel along its length, the collapsible stand forming a slot or gap for receiving and holding the keel. Stabilizing work piece levelers are included with the worktable.

Referring to the Figures, worktable 10 includes a collapsible stand 20 and a hinged, foldable tabletop 70 supported by the collapsible stand 20. The collapsible stand 20 is preferably made from standard aluminum ladder stock or the like. The collapsible stand 20 includes two side assemblies 26 formed by legs 30 at each end and connected by a middle cross member 32 and top cross member 34. Each side assembly 26 is the reverse configuration of the other and tilt upward and inward toward each other when erected to form a sawhorse-type structure when stand 20 is deployed for receiving worktable top 70.

Figure 6:
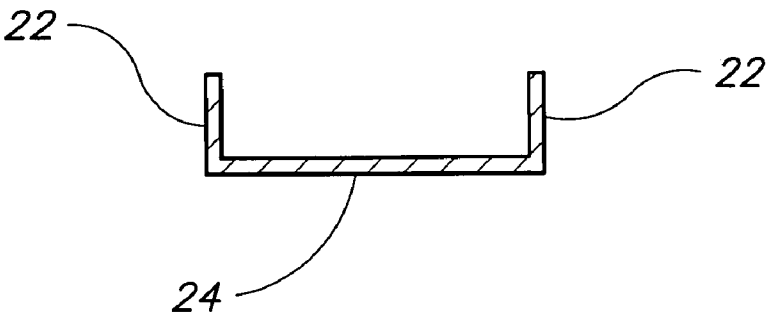
FIG. 6 is a cross-sectional view taken along the lines 6-6 of FIG. 5.

The legs 30 are preferable cut from "C"-type cross section material as shown in FIG. 6 with the legs 22 of the "C"-much shorter than the back 24 of the "C". The top ends of each side assembly 26 and the bottom ends (not shown) of the legs are cut so that when the bottom end of the leg sits on the floor, the legs tilt at an angle of about 15° from the vertical, tilting upward and inward to form the side assemblies 26.

Figure 7:
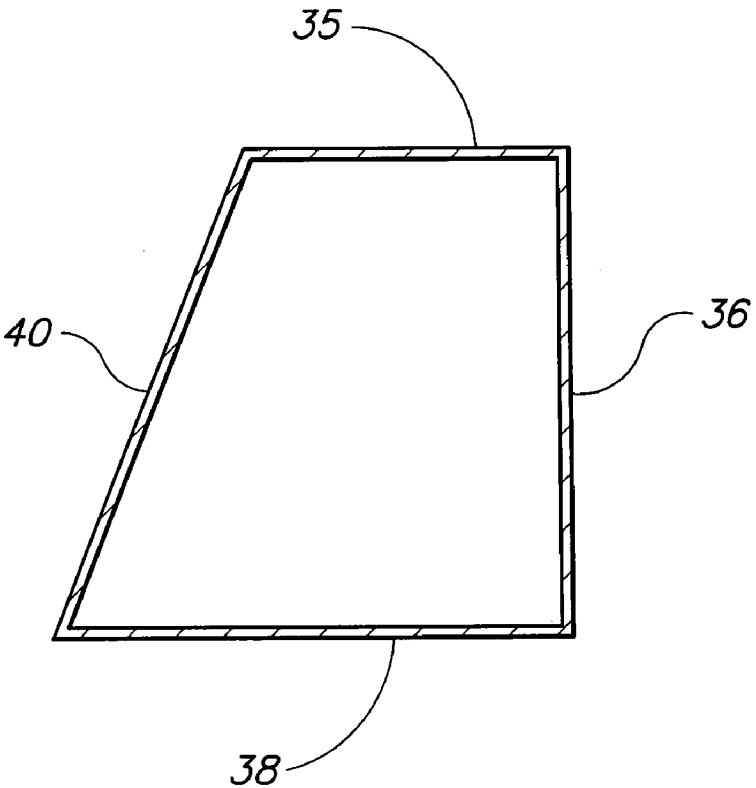
FIG. 7 is a cross-sectional view taken along the lines 7-7 of FIG. 2.

Each top cross member 34 is a unique feature of the stand, forming the elongate keel gap or groove 52 therebetween. Referring to FIG. 7, there is shown a cross sectional view of a top cross member 34 in the shape of a hollow trapezoid having an upper wall 35, an inner wall 36, and a lower wall 38 meeting at square corners, respectively, and an angled outer wall 40. Preferably, the upper wall 35 is about 3 inches in width, the inner wall 36 is about 3 inches in height and the lower wall is about three and ⅜ inches in width. Outer wall 40 is angled at about 15° from vertical to conform with legs 30 having outer side short legs to which it is attached at each end thereof by rivets 42.

The middle cross members 32 are preferably aluminum having a "C"-shaped cross section as that of legs 30, however, they are cut at right angles at each end for attachment to legs 30. The middle cross members 32 are of the same length as top cross members 34 and are attached to legs 30 about halfway up their length by rivets 44 running through the short legs 22 of the "C" for each leg 30. An angle support bracket 46 is attached between the outer short "C" leg 22 of a leg 30 to the short "C" leg (not shown) of the outer portion of the middle cross member 32 at each end thereof. The angle support bracket 46 is attached to the leg 30 below the midpoint by a rivet 48 and to the middle cross member 32 by a rivet 50 at angles of about 45°.

Each leg 30 has a non-skid foot pad 51 covering its lower end which contacts the floor or other surface upon which the deployed collapsible stand rests, the lower portions of the legs forming a stable support for table 10 when placed on flat ground surface.

The collapsible stand 20 is formed by tilting each side assembly 26 toward the other, with the flat sidewalls 36 of the top cross members 34 facing one another and leaving the keel gap 52 between the flat inside walls 36 into which the hereinafter described keel snugly fits. The side assemblies 26 are connected for limited rotation at each end thereof by top hinged brackets 54 and bottom hinged brackets 56.

Figure 4:
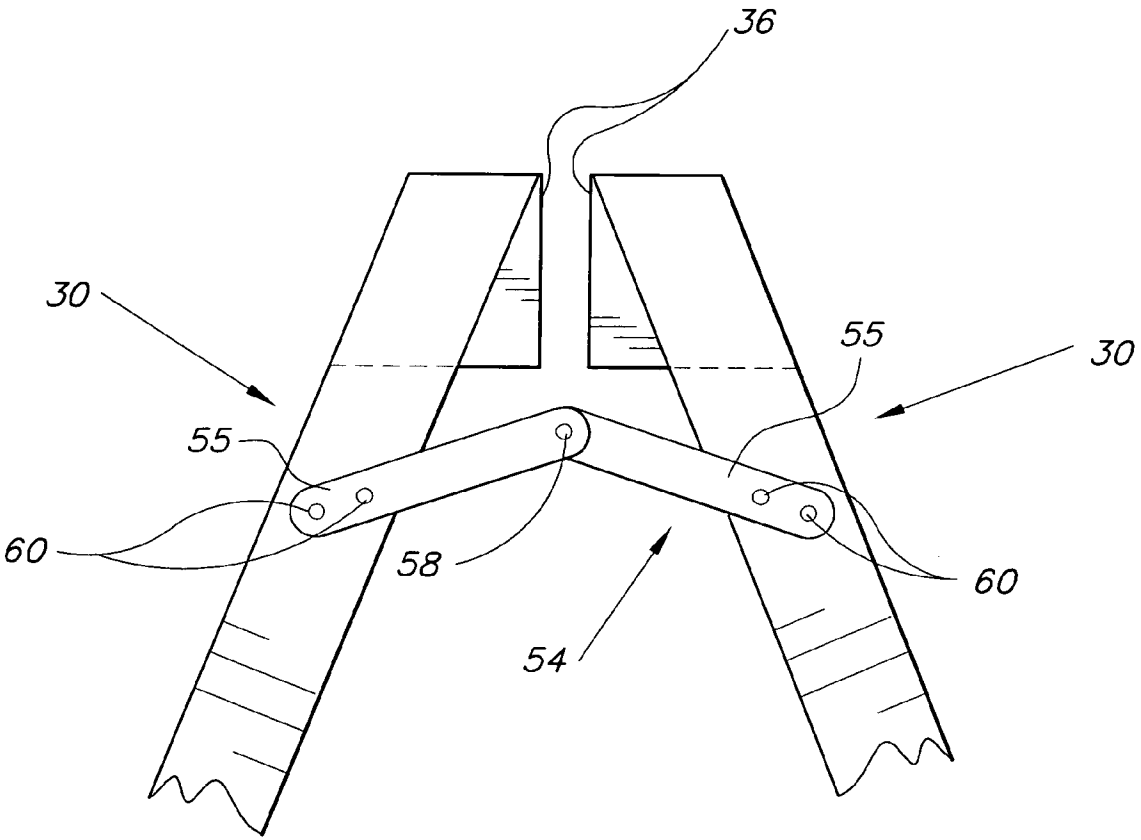
FIG. 4 is a partial, detail view of the top bracket, as seen in the upper portion of FIG. 3, and drawn to an enlarged scale.

Referring to FIG. 4, a top hinged bracket 54 is located at each side of the collapsible stand 20. The top hinged bracket 54 includes two elongate flat links 55 which are joined together at a mutual inner end by an axle rivet 58 about which they are free to pivot. Each outer end of top hinged bracket 54 is attached to a corresponding leg 30 slightly below the line where the bottom walls 38 of the top cross members 34 meet legs 30. The outer ends of the top hinged bracket are fixed to legs 30 by rivets 60 and placed at an angle with the apex of the angle pointed toward the top of the collapsible stand 20. The degree of the angle of placement of the hinged bracket outer ends is such that the side assemblies 26 of the collapsible stand can be folded together.

Figure 5:
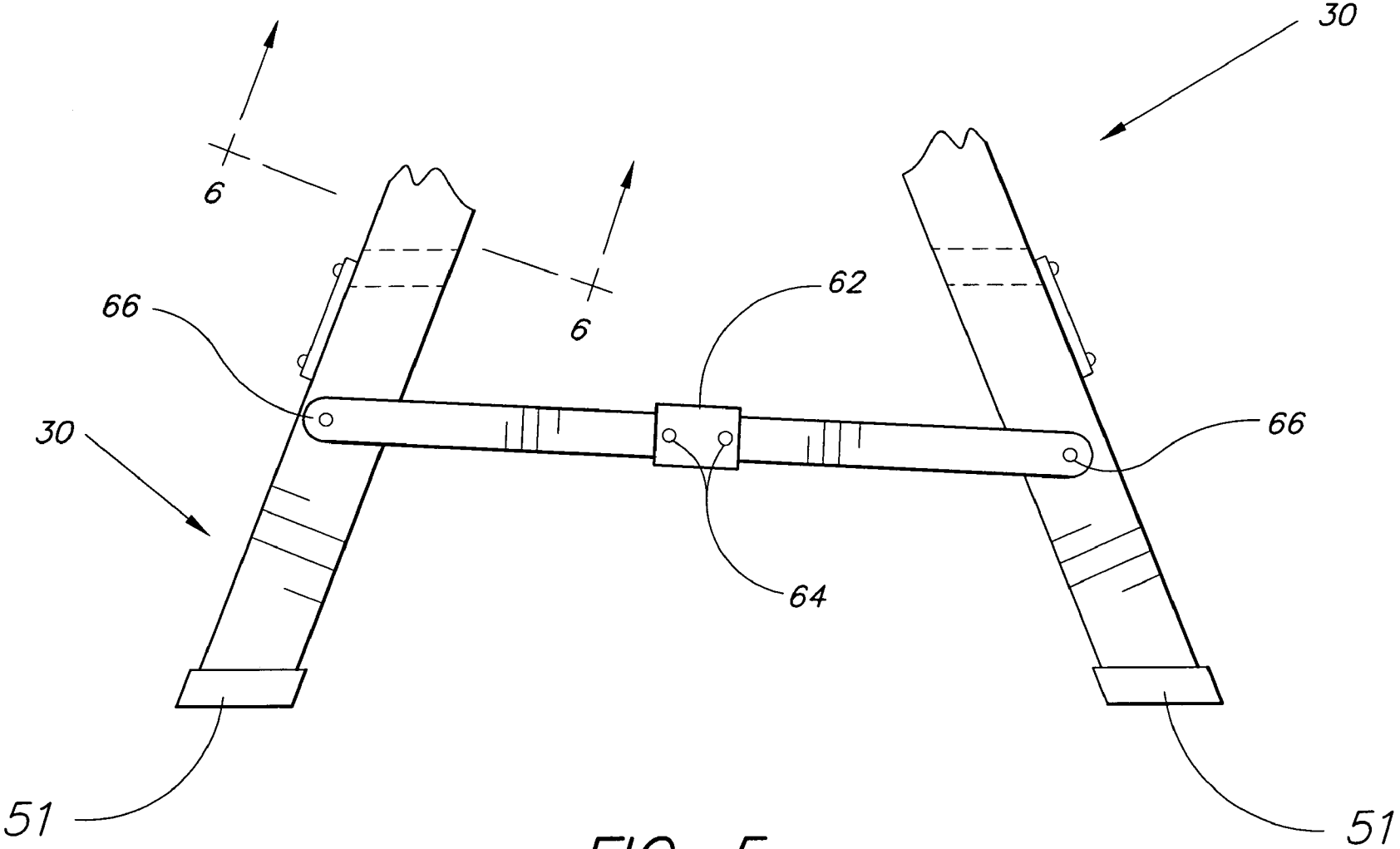
FIG. 5 is a partial, detail view of the bottom folding bracket, as seen in the lower portion of FIG. 3, and drawn to an enlarged scale.

Likewise, as shown in FIG. 5, a bottom bracket 56 is located at each side of the collapsible stand 20. The bottom bracket 56 includes two elongate flat links of equal length, joined together at mutual inner ends by a metal keeper 62 by means of axle keeper rivets 64 which allows the bottom hinge bracket 56 to collapse inward and upward during folding of the stand, while locking the stand 20 in an extended position upon the side assemblies 26 being spread to their fullest extend when deployed for use. The outer ends of the bottom hinge bracket 56 are pivotally attached to the legs 30 of the collapsible stand 20 by axle rivets 66. On one outer end, the rivet 66 of bracket 56 is placed about two-thirds down from the point of the meeting of the lower edge of the middle cross member 32 and the leg 30. The other outer end of the bottom bracket 56 is placed slightly higher on the opposite leg 30 so that when the bottom bracket 56 is fully extended and locked, it is at a slightly elevated angle from the horizontal.

It is the combination of brackets and angles that provide the opened collapsible stand its rigidity and stability, while creating the keel gap or slot into which the hereinafter described keel 78 if fitted.

Figure 8:
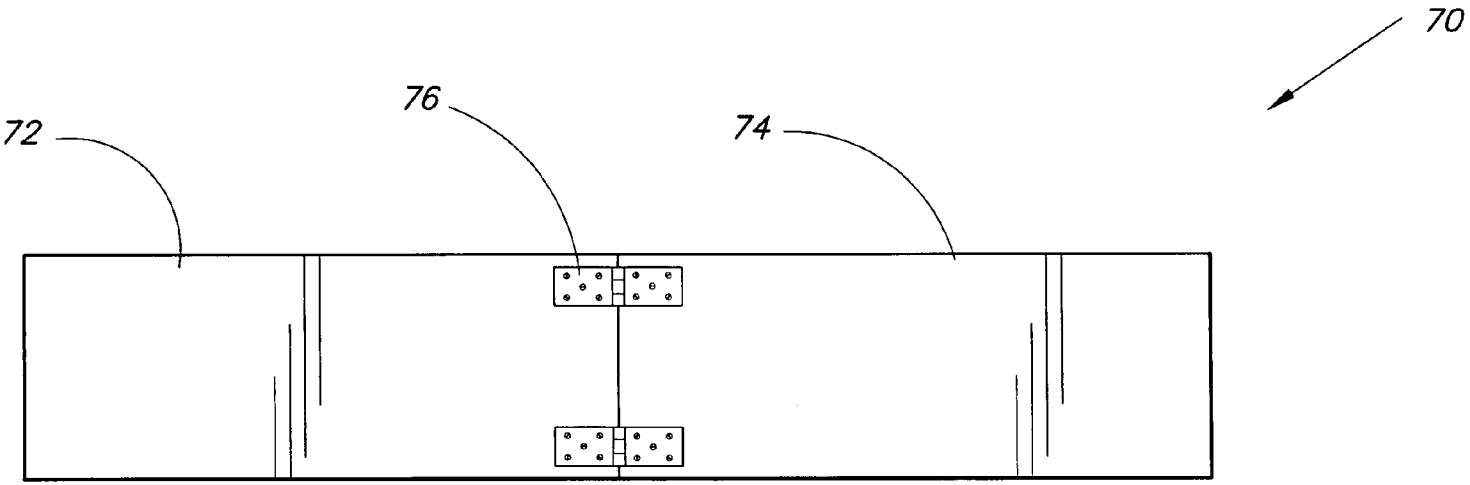
FIG. 8 is a top view of the flat, folding, supportive table surface.
Figure 9:
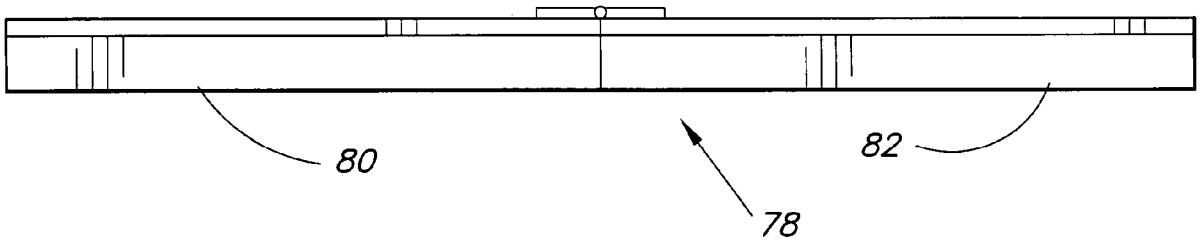
FIG. 9 is a front elevational view of the flat table surface of FIG. 8.

The hinged table top 70 as shown in FIG. 8, is the other major component of the collapsible portable workstand 10. The hinged top 10 includes two identical rectangular portions 72 and 74, held together by two hinges 76 so as to fold upward from the horizontal. Keel portions 80 and 82 are centrally affixed, lengthwise, to the underside of corresponding top portions 72 and 74 to form keel 78 upon unfolding of the table top 70. The width of the table top 70 is preferably about 6 inches with the length about 5 feet. The corners of the rectangular portion 72 and 74 are preferably rounded. The keel 78 is preferably about twice the length of that of the top cross members 34 of the collapsible stand 20. The depth of the keel 78 is preferably about four and the width about 1 inch. The keel 78 is preferably made of aluminum, as is the table top 70. The inner ends of the keel portions 80 and 82 join one another as the inner ends of the table top portions. When the collapsible stand 20 is fully deployed the keel 78 fits snugly into the keel gap or slot 52 between the inside flat walls 36 of top cross members 34 the weight of the side assemblies 26, table top 70, and any equipment on the table top 70 pushing down, forces inner faces 36 of top cross members 34 inward against the keel 78 so as to secure the table top 70 in place during use. Although table top 70 is described and shown as about 6 inches in width, the table of the invention may be substantially wider and directed to other uses such as a work table.

Figure 10:
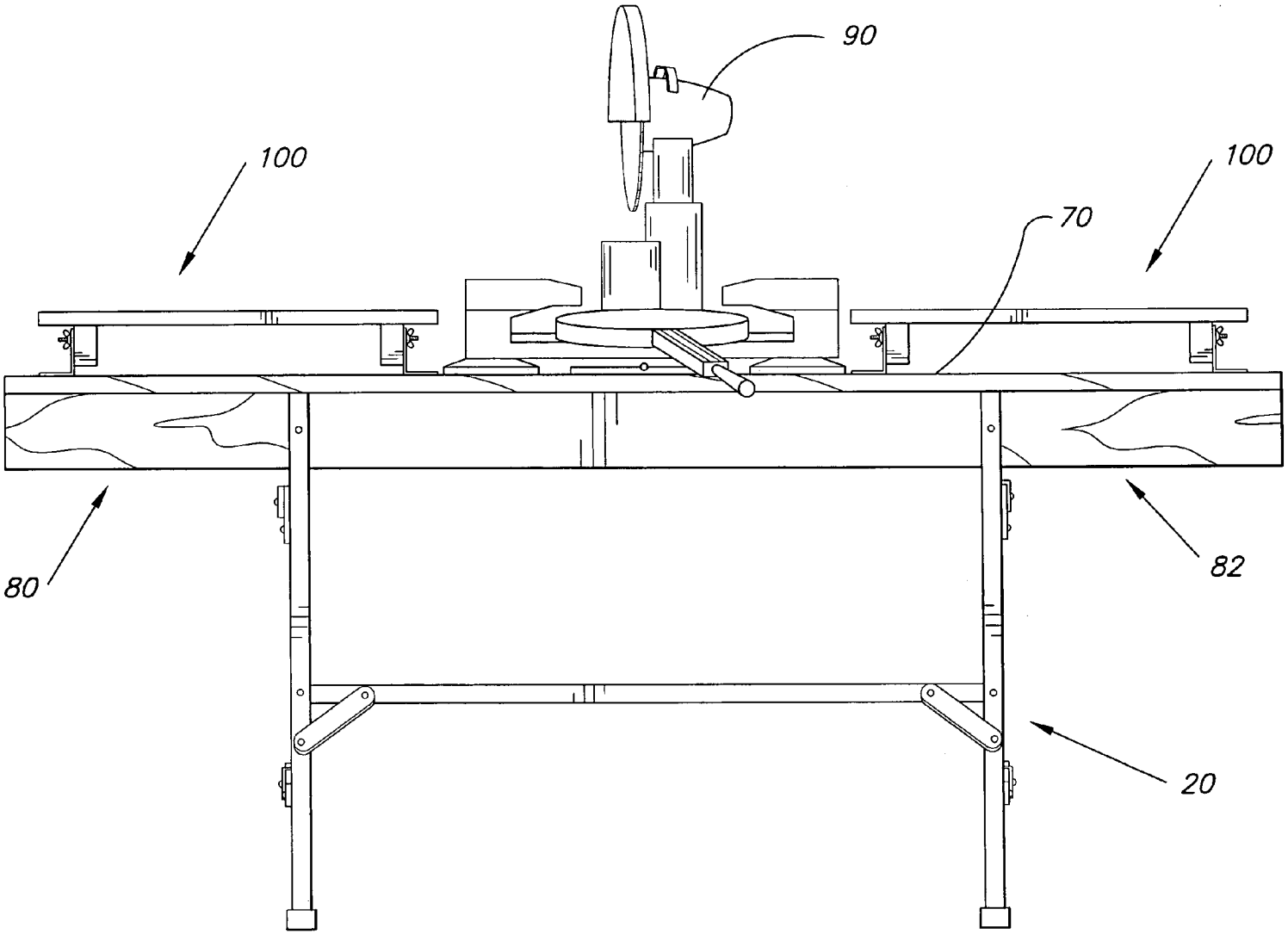
FIG. 10 is a front elevational view of the collapsible worktable of FIG. 1 with a miter saw and leveler devices resting thereon.

Referring to FIG. 10, when the collapsible stand 20 is fully deployed with the tabletop 70 in place, a miter saw or other power tool 90 can be placed on the tabletop 70.

Figure 11:
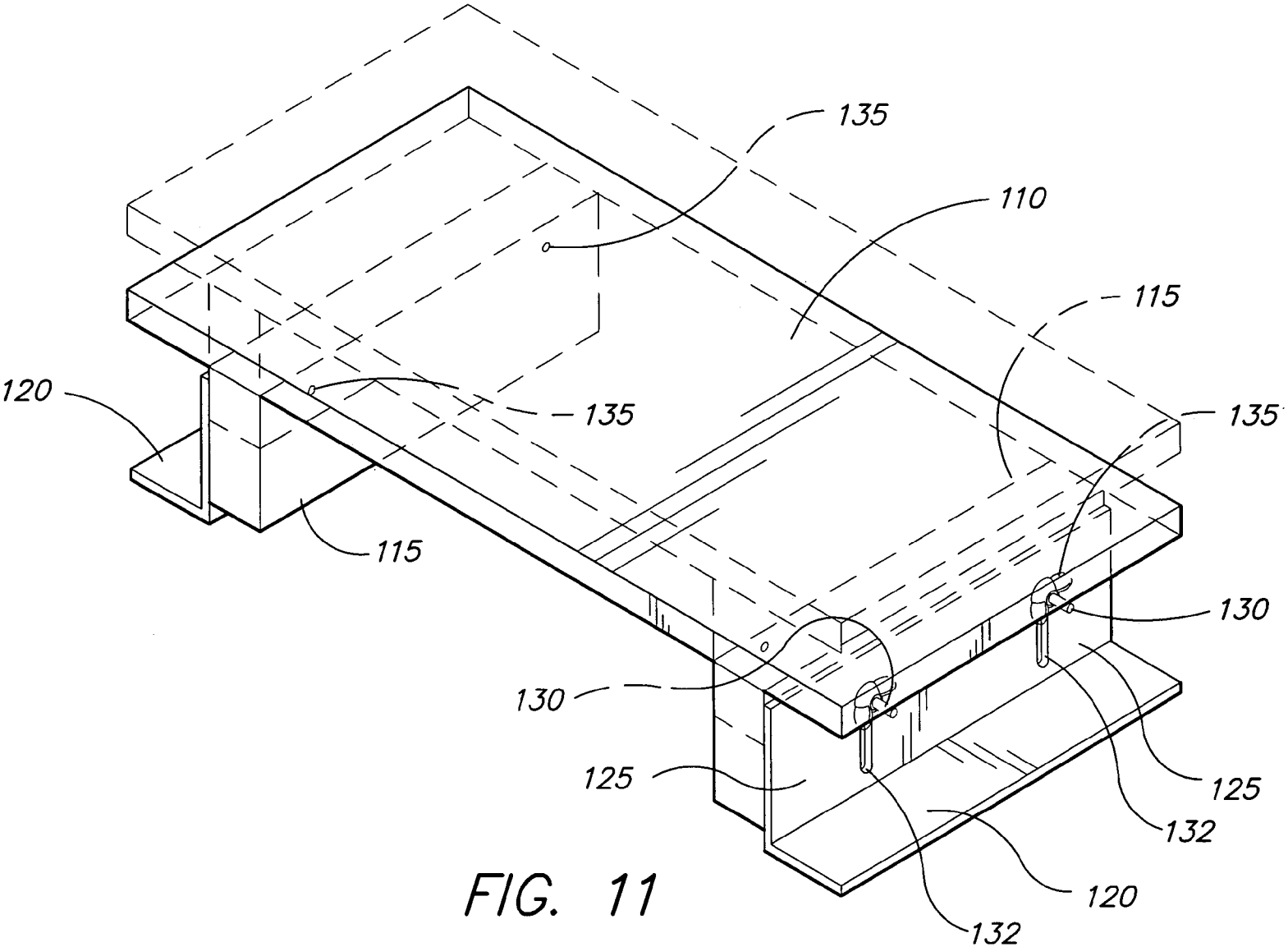
FIG. 11 is a perspective view of a leveler device of FIG. 10.

Referring to FIG. 11, workpiece levelers may be placed on the tabletop 70. The workpiece levelers 100 can be used to raise workpiece material above the plane of the tabletop 70 or can be used in conjunction with a power tool, such as a miter saw, as shown. A representative leveler 100 has a rectangular top surface 110 which is a sheet about one-half inch thick having a width of about seven inches and a length of about 19 inches. The top surface 110 is supported at points spaced inward from each end by bottom blocks 115 of hollow aluminum extending crosswise relative to the top surface 110. Bottom blocks 115 have caps at each end. The blocks 115 are supported at their respective outer sides by "L"-shaped support brackets 120 having vertical walls 125 and defining spaced, vertical slots 132. Blocks 115 have studs 130 extending outward from their outer ends through respective slots 132 in support brackets 120 and which have wing nuts 135 for releasably tightening over studs 130 against vertical walls 125, thus supporting top surface 110 at a desired height relative to the support brackets 120. By loosening the wing nuts 135, the height of the top surface 110 of leveler 100 may be adjusted in a range.

It is to be understood that the present invention is not limited to the embodiments described above, but encompasses any and all embodiments within the scope of the following claims.

I claim:

1. A table for a portable miter saw, comprising:

a collapsible stand comprising:

two opposed side assemblies having end portions, each side assembly having respective end legs at each end portion, said end legs having an upper portion, a middle portion, and a lower portion and connected by a top cross member at the respective upper end portions thereof and a middle cross member at the respective middle portions thereof, each of said top cross members being trapezoidal in cross section having respective vertical inner walls when said collapsible stand is erect and having angled outer walls parallel with said end legs of said side assemblies;

said side assemblies being connected at each end portion thereof by at least one hinge bracket, said respective top cross members being spaced to define a keel gap therebetween; and a table top having an upper surface having a central portion, said table top having an elongate keel depending from said central portion and so configured as to snugly fit within said keel gap;

whereby, upon erection of said collapsible stand, said keel gap is formed by said top cross members and said table top elongate keel is inserted and secured within said keel gap forming a table.

2. The table of claim 1, wherein said side assemblies upon erection of said collapsible stand to an erected state form inward and upward angles relative to each other such that said end legs and said top cross members form a sawhorse type structure defining said keel gap between said top cross members, said lower portions of said respective end legs being spread substantially wider than said keel gap, forming a steady base therefor.

3. The table of claim 2, wherein said at least one hinge bracket of each said end portion of said collapsible stand provides for folding of said opposed side assemblies together to a collapsed state.

4. The table of claim 3, wherein said at least one hinge bracket comprises an upper hinge bracket and a lower hinge bracket connecting said end portions of said opposed side assemblies.

5. The table of claim 4, said upper hinge brackets each comprising two elongate links having remote ends and connecting ends and pivotally attached at the remote ends to said upper portions of said end legs of said opposed side assemblies at a location spaced below said top cross members and the connecting ends being pivotally connected by an axle rivet.

6. The table of claim 5, said lower hinge brackets each comprising two elongate links brackets having remote ends and connecting ends and pivotally attached at their remote ends to said middle portions of said end legs of said opposed side assemblies, the connecting ends being attached by rivet axles to a keeper, whereby said lower hinge brackets may only fold upward.

7. The table of claim 6, wherein said remote ends of said lower hinge brackets are attached at a higher point along the end legs of one side assembly than on those of the opposite side assembly.

8. The table of claim 1, wherein said table top is rectangular in shape, said keel extending lengthwise under said upper surface thereof.

9. The table of claim 8, wherein said table top includes two surface portions of equal size, each having aligned keel portions depending therefrom, respectively, said surface portions attached by hinges so as to fold upward.

10. The table of claim 9, further comprising a leveler located on at least one of said surface portions for supporting a workpiece above said table top.

11. The table of claim 10, wherein each said leveler comprises a rectangular top surface supported at each end by support blocks mounted to support brackets having vertical walls with vertical slots therein, said support blocks being mounted by studs extending through said vertical slots and adjustably secured for vertical travel by thumb screw.

12. A table for a portable miter saw, comprising:

a collapsible stand comprising:

two opposed side assemblies having end portions, each side assembly having respective end legs at each end portion, said end legs having an upper portion, a middle portion, and a lower portion and connected by a top cross member at the respective upper end portions thereof and a middle cross member at the respective middle portions thereof;

said side assemblies being connected at each end portion thereof by at least one hinge bracket, said respective top cross members being spaced to define a keel gap therebetween;

a table top having an upper surface having a central portion, said table top having an elongate keel depending from said central portion and so configured as to snugly fit within said keel gap;

wherein said side assemblies upon erection of said collapsible stand to an erected state form inward and upward angles relative to each other such that said end legs and said top cross members form a sawhorse type structure defining said keel gap between said top cross members, said lower portions of said respective end legs being spread substantially wider than said keel gap, forming a steady base therefore;

wherein said at least one hinge bracket of each said end portion of said collapsible stand provides for folding of said opposed side assemblies together to a collapsed state; and wherein said at least one hinge bracket comprises a top hinge bracket and a bottom bracket connecting said end portions of said opposed side assemblies, said top hinge brackets each comprising two elongate links having remote ends and connecting ends and pivotally attached at their remote ends to said upper portions of said end legs of said opposed side assemblies at a location spaced below said top cross members and the connecting ends being pivotally connected by an axle rivet; and said bottom hinge brackets each comprising two elongate links having remote ends and connecting ends and pivotally attached at the remote ends to said middle portions of said end legs of said opposed side assemblies, the connecting ends being attached by rivet axles to a keeper, whereby said bottom hinge brackets may only fold upward, and wherein said remote ends of said bottom hinge brackets are attached at a higher point along the end legs of one side assembly than on those of the opposite side assembly;

whereby, upon erection of said collapsible stand, said keel gap is formed by said top cross members and said table top elongate keel is inserted and secured within said keel gap forming a table.

13. The table of claim 12, said top cross brackets being trapezoidal in cross section having respective vertical inner walls when said collapsible stand is erect, and having angled outer walls parallel with said end legs of said side assemblies.

14. The table of claim 13, wherein said table top is rectangular in shape, said keel extending lengthwise under the top surface thereof.

15. The table of claim 14, wherein said table top includes two surface portions of equal size, each having aligned keel portions depending therefrom, respectively, said surface portions attached by hinges so as to fold upward.

16. A table for a portable miter saw, comprising:

a collapsible stand comprising:

two opposed side assemblies having end portions, each side assembly having respective end legs at each end portion, said end legs having an upper portion, a middle portion, and a lower portion and connected by a top cross member at the respective upper end portions thereof and a middle cross member at the respective middle portions thereof;

said side assemblies being connected at each end portion thereof by at least one hinge bracket, said respective top cross members being spaced to define a keel gap therebetween;

a table top having an upper surface having a central portion, said table top having an elongate keel depending from said central portion and so configured as to snugly fit within said keel gap;

wherein said side assemblies upon erection of said collapsible stand to an erected state form inward and upward angles relative to each other such that said end legs and said top cross members form a sawhorse type structure defining said keel gap between said top cross members, said lower portions of said respective end legs being spread substantially wider than said keel gap, forming a steady base therefor;

wherein said at least one hinge bracket of each said end portion of said collapsible stand provides for folding of said opposed side assemblies together to a collapsed state;

wherein said at least one hinge bracket comprises an upper hinge bracket and a lower hinge bracket connecting said end portions of said opposed side assemblies;

wherein said table top is rectangular in shape, said keel extending lengthwise under the top surface thereof; and wherein said table top includes two surface portions of equal size, each having aligned keel portions depending therefrom, respectively, said surface portions attached by hinges so as to fold upward;

whereby, upon erection of said collapsible stand, said keel gap is formed by said top cross members and said table top elongate keel is inserted and secured within said keel gap forming a table.

17. The table of claim 16, said lower hinge brackets each comprising two elongate links brackets having remote ends and connecting ends and pivotally attached at the remote ends to said middle portions of said end legs of said opposed side assemblies, the connecting ends being attached by rivet axles to a keeper, whereby said lower hinge brackets may only fold upward.

18. The table of claim 17, said top cross brackets being trapezoidal in cross section having respective vertical inner walls when said collapsible stand is erect, and having angled outer walls parallel with said end legs of said side assemblies.

* * * * *